US007401556B2

(12) United States Patent
McCarty et al.

(10) Patent No.: US 7,401,556 B2
(45) Date of Patent: Jul. 22, 2008

(54) FIXTURE FOR PRINTING BLINDS

(75) Inventors: Michael J. McCarty, Rancho Santa Margarita, CA (US); Mike Edwards, Fountain Valley, CA (US)

(73) Assignee: 3 Day Blinds, Inc., Anaheim, CA (US)

( * ) Notice: Subject to any disclaimer, the term of this patent is extended or adjusted under 35 U.S.C. 154(b) by 0 days.

(21) Appl. No.: 11/683,882

(22) Filed: Mar. 8, 2007

(65) Prior Publication Data

US 2007/0221084 A1 Sep. 27, 2007

Related U.S. Application Data

(62) Division of application No. 10/852,614, filed on May 24, 2004, now Pat. No. 7,207,270.

(60) Provisional application No. 60/535,441, filed on Jan. 9, 2004.

(51) Int. Cl.
*B41F 1/34* (2006.01)

(52) U.S. Cl. ..... 101/485; 101/483

(58) Field of Classification Search ..... 101/479, 101/474, 483, 485, 490
See application file for complete search history.

(56) References Cited

U.S. PATENT DOCUMENTS

| | | | | |
|---|---|---|---|---|
| 4,711,005 | A | 12/1987 | Chang | |
| 4,953,459 | A * | 9/1990 | Ericsson | 101/115 |
| 5,037,253 | A | 8/1991 | Molaro et al. | |
| 5,195,434 | A * | 3/1993 | Hoffman | 101/126 |
| 5,339,716 | A | 8/1994 | Sands et al. | |
| 5,795,491 | A | 8/1998 | Ciriaci | |
| 6,003,218 | A | 12/1999 | Schumann et al. | |
| 6,272,989 | B1 | 8/2001 | Misono et al. | |
| 6,286,920 | B1 | 9/2001 | Ridgway | |
| 6,378,421 | B1 | 4/2002 | Chiu | |
| 6,550,379 | B2 | 4/2003 | Chiu | |
| 7,017,853 | B2 * | 3/2006 | Colson et al. | 242/530.1 |
| 7,034,248 | B2 * | 4/2006 | Crouse et al. | 219/121.68 |
| 7,207,270 | B2 | 4/2007 | McCarty et al. | |
| 2001/0054369 | A1 | 12/2001 | Braley | |

FOREIGN PATENT DOCUMENTS

| | | |
|---|---|---|
| EP | 250612 A1 | 1/1988 |
| EP | 347476 A1 | 12/1989 |
| EP | 348885 A2 | 1/1990 |

* cited by examiner

*Primary Examiner*—Anthony H. Nguyen
(74) *Attorney, Agent, or Firm*—Stetina Brunda Garred & Brucker

(57) ABSTRACT

Provided is a fixture assembly for printing image graphics on a slat set of a window blind. The slat set is comprised of a plurality of substantially identically configured slats. Each one of the slats has a slat length and a slat width. The fixture assembly comprises a horizontally extending panel having an upper panel surface with opposed panel ends and opposed panel sides respectively defining a panel length and a panel width. The fixture assembly further comprises a plurality of substantially identically configured elongate inserts mounted on the upper panel surface in parallel spaced relation to one another. Each one of the inserts is configured to receive and support one of the slats in a generally horizontal orientation. The inserts are spaced complementary to the slat width such that the slats are supported on the inserts in abutting contact with one another.

13 Claims, 4 Drawing Sheets

FIXTURE FOR PRINTING BLINDS

CROSS-REFERENCE TO RELATED APPLICATIONS

The present application is a divisional application of U.S. patent application Ser. No. 10/852,614, filed May 24, 2004, now U.S. Pat. No. 7,207,270 which claims priority to the U.S. Provisional Application Ser. No. 60/535,441, filed Jan. 9, 2004, now abandoned.

STATEMENT RE: FEDERALLY SPONSORED RESEARCH/DEVELOPMENT (Not Applicable)

BACKGROUND OF THE INVENTION

The present invention relates generally to printing devices and, more particularly, to a uniquely configured fixture assembly specifically adapted for printing image graphics on window blinds using ink that is curable upon exposure to radiation such as ultraviolet (UV) radiation.

Window blinds constructed of elongate louvers or slats provide both aesthetic and light control utility for home and commercial installations. Such window blinds typically include a spaced plurality of slats that are aligned with each other and which include mechanisms for raising and lowering the slats and/or arranging the angle of the slats between open and closed positions. The angle of each one of the slats is rotatable about a longitudinal axis extending along a length of the slat. In addition to having the plurality of slats, some window blinds may also include a valance that covers a housing for the raising/lowering and slat angle-adjusting mechanisms. The valance is typically designed to blend with the style, color, etc. of the slats.

For aesthetic reasons, decorators often desire to provide the interior-facing portion of window blinds with certain colors and images that will match or blend with the interior design of a room. For functional reasons, it may also be desirable to provide the exterior-facing portion of the window blind with certain image graphics in order to covey messages such as commercial advertising messages, public service messages, political messages, and the like. One of the advantages of including such messages on exterior-facing portions of window blinds is that the visibility of such messages may be controlled by simply rotating the angle of the slats about its longitudinal axis between the open and closed positions.

Window blinds are commercially available in a wide variety of configurations and may be classified according to the overall arrangement of the slats. For example, window blinds having slats that are vertically positioned are sometimes referred to as vertical blinds. In vertical blinds, the slats are generally hung or suspended at one end from the control mechanism which is typically installed above a window. Window blinds having slats that are horizontally positioned may be referred to as horizontal blinds and may include plantation shutters, mini blinds, and others.

For window blinds having slats that are horizontally positioned, each one of the slats is typically rotatable about the longitudinal axis between a horizontal and a vertical orientation. When the slats are rotated to the horizontal orientation, the window blind is placed in the open position such that messages represented by the image graphic printed on the slats are not directly visible. However, when the window blind is placed in the closed position such that the slats are rotated about the longitudinal axis to the vertical orientation, the visibility of the image graphic is restored. The visibility of such image graphic may also be controlled by simply raising and lowering the slats. For window blinds having slats that are vertically positioned (i.e., vertical blinds), the slats are rotatable about the longitudinal axis such that faces of the slats are either aligned with one another in the closed position, or oriented parallel to one another in the open position. In this manner, the visibility of the image graphic on such vertical blinds may be easily regulated.

While simply painting the slats is a cost-effective method for changing the color of window blinds, changing the pattern or image graphic of such window blinds presents a greater challenge. The prior art includes several systems developed as a means for changing the image graphic of window blinds. For example, one system involves a blind having slats with rectangularly shaped frames of U-shaped cross section that form a channel capable of holding a decorative insert. The decorative insert may be constructed of paper or cardboard that may be enclosed within a transparent material. Unfortunately, the insert is supported only at its outer edges allowing the insert to sag near the center portion. In addition, the transparent material enclosing the insert detracts from the overall aesthetics of the window blind. Finally, the pattern on each insert must be aligned with the pattern of adjacent inserts in order to ensure a uniform appearance of the window blind. Precisely aligning the patterns of adjacent inserts may require the expenditure of considerable time and effort that may reduce the overall cost-effectiveness of the system.

Digital printing systems have becoming increasingly popular as a method for transferring image graphics. Techniques have been developed that combine computers with inkjet printers in order to print color image graphics onto paper or other receiving substrates with relatively high speed and excellent image resolution. In addition, the use of computers provides great flexibility and variety in the design and layout of the image graphics. Large format inkjet printing systems are used for many applications such as printing of architectural and engineering drawings and printing of conventional polymeric films. Improvements in ink technology provide the ability to print in large format using inkjet printing to produce presentation-quality images at very high speed with image graphics that have a high degree of outdoor durability, including colorfast stability despite continuous exposure to sunlight.

In view of the above-mentioned desire to add or change the overall appearance of window blinds and the deficiencies of prior art systems directed to effect such changes, there exists a need in the art for a system and method for inkjet printing of image graphics on window blinds. Furthermore, there exists a need in the art for a simple and cost-effective system for maintaining the relative positioning of the slats during printing of a window blind such that large format printers can be used to print such image graphics thereon. Finally, there exists a need in the art for a system and method for inkjet printing of image graphics on window blinds that is simple and low-cost.

BRIEF SUMMARY OF THE INVENTION

The present invention provides a uniquely configured fixture assembly and method specifically adapted for ink jet printing of image graphics on window blinds using ultraviolet (UV) radiation curable ink. The window blind includes a plurality or series of slats that are typically generally horizontally disposed when hung such as in a window installation. The series of slats in such window blinds is typically comprised of substantially identically configured slats wherein each slat has a slat length and a slat width. Each one of the slats in the series may include a planar portion and an angled portion although the slats may be curved in an arc shape.

A large format, UV radiation curable piezo inkjet printer may be used with the fixture assembly of the present invention. The fixture assembly comprises a horizontally extending panel having a plurality of elongate inserts mounted in parallel spaced relation to each other. In an alternative embodiment, each one of the inserts may be configured as a series of generally aligned insert segments. The panel has an upper panel surface with opposed panel ends and opposed panel sides respectively defining a panel length and a panel width. The inserts are preferably of substantially identical configuration. Likewise, each one of the insert segments is preferably provided in substantially identical configurations. Each one of the inserts is preferably spaced complementary to the slat width such that the slats are supported on the inserts in substantially abutting or overlapping contact with each other to minimize the risk of printing on non-planar or angled portions of the slats.

The inserts are preferably configured to generally span the panel width in order to simplify construction of the fixture assembly. The panel may be configured such that the panel width is at least equivalent to the slat length. The fixture assembly may include vertical side walls that extend along the panel ends and the panel sides. Such side walls may also preferably extend upwardly to a level that is slightly above that of the upper insert surface such that ends of the slats may be butted thereagainst. Each one of the inserts may have a generally rectangular cross-sectional shape and may preferably be sized complementary to the slat such that the planar portion is maintained in a generally horizontal orientation with the angled portion extending downwardly into abutting contact with both the upper panel surface and with a side of an adjacent one of the inserts.

Each one of the inserts may further include a rib that is generally aligned with the upper insert surface and which extends laterally outwardly from one of the inserts sides. The inserts may be oriented such that each one of the ribs generally faces toward one of the panel ends although various combinations of orientations of the ribs are contemplated. The slats may be positioned such that angled portions thereof may be partially covered by the rib of an adjacent one of the inserts. The insert spacing is preferably substantially equivalent to the slat width such that each one of the slats may be disposed in generally abutting contact with one another. Vacuum channels may be provided in the panel and vacuum ports may be included in the inserts in order the low pressure applied therethrough may draw the slats against the inserts to restrict movement thereof during printing.

The inserts are preferably fabricated from material that is generally repellant or non-receptive to ink such as a nylon polymeric material including Delrin®, commercially available from the Dupont Corporation. The panel of the fixture assembly may preferably be constructed of wood or metal in order to provide sufficient strength and rigidity to the fixture assembly. The inserts may be secured to the panel by means of mechanical fasteners such as screws or bolts. The height of the fixture assembly may be limited to about three inches to ensure compatibility with commercially available printers although the fixture assembly may be provided in any height. An overall width of the fixture assembly may likewise be limited to about ninety-eight inches while a preferred length and width of the fixture assembly may be about forty-eight inches and about ninety-six inches, respectively.

In operation, the fixture assembly may be used in conjunction with the printer in order to print image graphics on at least one of the slat sets although a plurality of the fixture assemblies may be used to successively print image graphics on multiple ones of the slat sets in assembly line fashion. A method for printing the image graphics in assembly line fashion comprises providing the plurality of fixture assemblies. The slat sets may be mounted on each one of the fixture assemblies. The fixture assemblies may then by loaded onto the printer in one-at-a-time fashion with the fixture assemblies being positioned to be in general alignment with the printhead of the printer. Low pressure may be applied to draw the slats against the inserts to prevent movement. Following application of ink to the slat sets and curing of the ink, the fixture assemblies are offloaded from the printer after removing the low pressure. When all fixture assemblies are cycled through the printer, the slat sets are then removed from the fixture assemblies to allow for removal of any ink overprinting therefrom.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
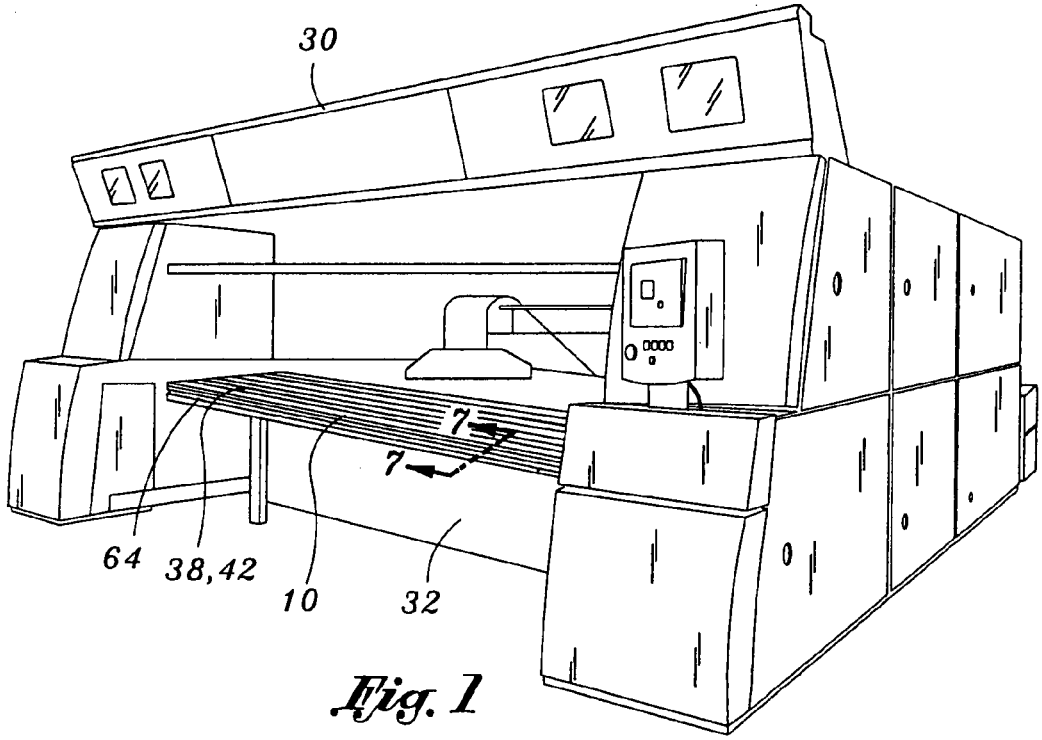
FIG. 1 is a perspective view of a printer and a horizontally extending fixture assembly of the present invention as may be used with the printer.

Referring now to the drawings wherein the showings are for purposes of illustrating the present invention only, and not for purposes of limiting the same, the invention is directed to a fixture assembly 10 that is specifically configured to support a series of elongate louvers or slats 40 of a Venetian blind or a window blind 38 such that an inkjet printer 30 may be used to print image graphics on the window blind 38.

Figure 2:
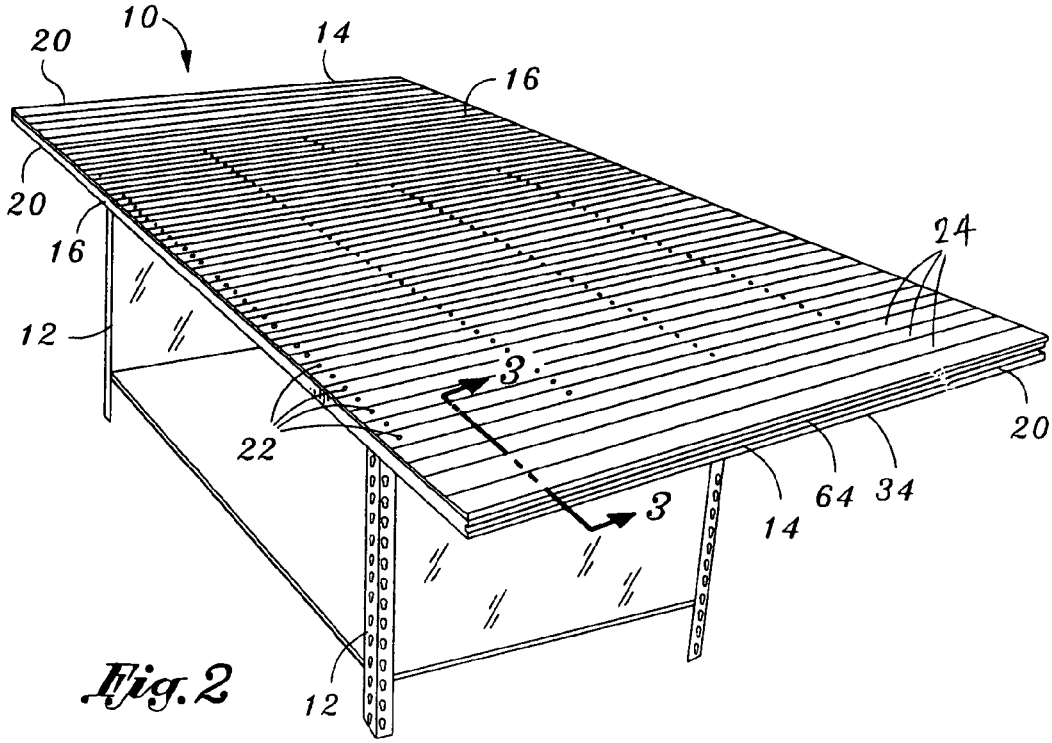
FIG. 2 is a perspective view of the fixture assembly of the present invention.

The fixture assembly 10 includes a plurality of inserts 24 disposed in generally parallel spaced relation to one another. The inserts 24 of the fixture assembly 10 may be substantially identically configured although the inserts 24 may have a variety of alternate configurations on a single one of the fixture assemblies 10. In one embodiment of the fixture assembly 10, each one of the inserts 24 may generally be of one-piece construction and configured to receive and support one of the slats 40 of the window blind 38 in a generally horizontal orientation, as is shown in FIG. 2 and as will be described in greater detail below.

Figure 3:
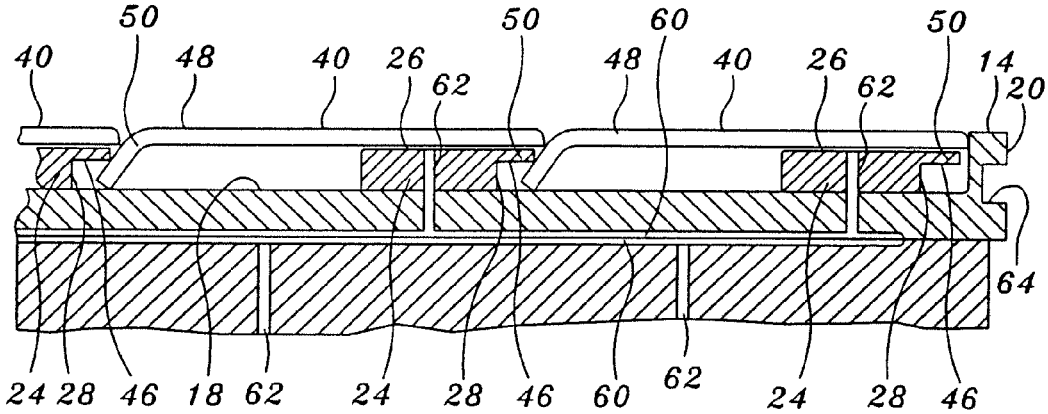
FIG. 3 is a partial cross-sectional view of the fixture assembly taken along line 3-3 of FIG. 2 illustrating a plurality of inserts having a slat set disposed thereon.
Figure 3A:
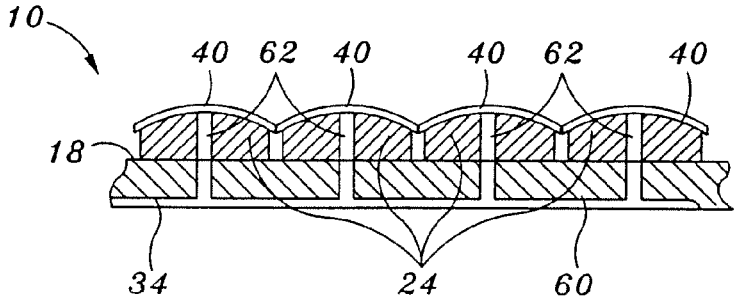
FIG. 3*a* is a partial cross-sectional view of the fixture assembly taken along line 3*a*-3*a* of FIG. 2 illustrating an alternative cross-sectional shape of the insert for supporting slats of curved configuration.
Figure 5:
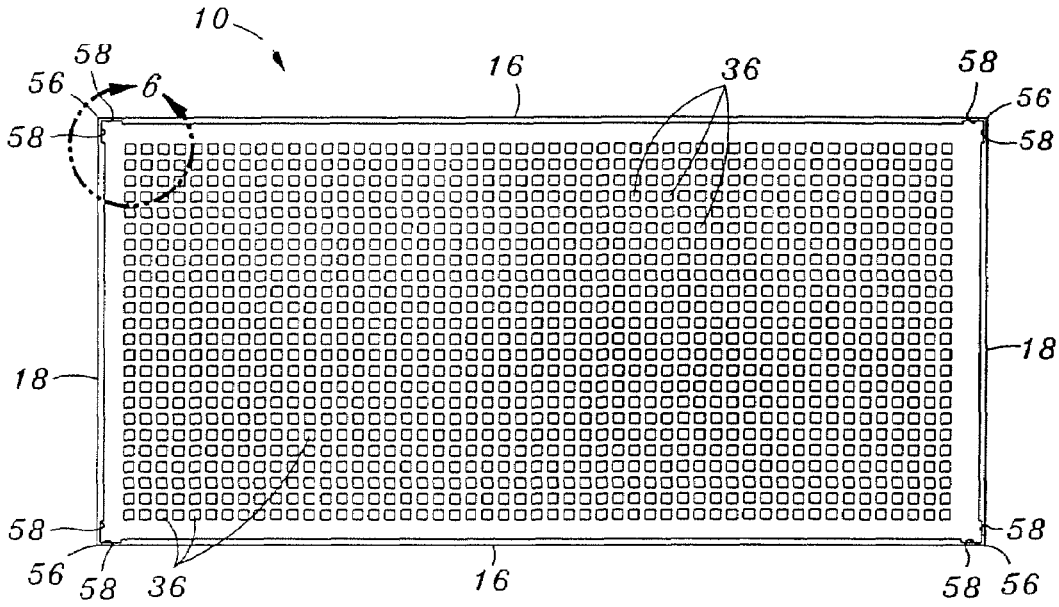
FIG. 5 is a plan view of the fixture assembly in an alternative embodiment wherein each one of the inserts is comprised as a series of insert segments.
Figure 6:
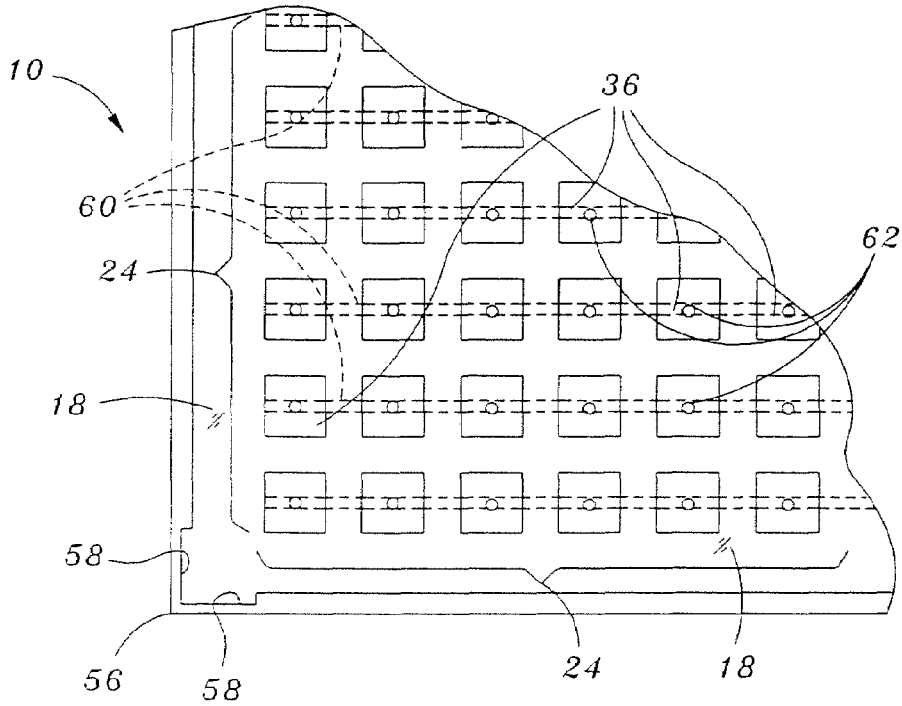
FIG. 6 is a partially enlarged plan view of the fixture assembly taken along line 6-6 of FIG. 5 and illustrating a corner configured for mounting a valance of the fixture assembly in mutually perpendicular orientations.

In an alternative embodiment of the fixture assembly 10, each one of the inserts 24 may be comprised of a series of insert segments 36 disposed in general alignment with one another such that slats 40 of the window blind 38 may be oriented on the fixture assembly 10 in one of mutually perpendicular orientations, as is shown in FIGS. 5 and 6 and as will also be described in greater detail below. Furthermore, the inserts 24 may be provided in a variety of alternative cross-sectional shapes for supporting slats 40 of varying geometry. For example, FIG. 3*a* illustrates the inserts 24 having concave upper insert surfaces 26 for supporting slats 40 have a curved configuration such as may be utilized in mini-blinds and/or in vertical blinds. Alternatively, FIG. 3*b* illustrates the inserts 24 having a wedge shape for supporting slats 40 having an overlapping configuration such as is typically employed in plantation shutters.

Window blinds 38 are typically comprised of slats 40 forming a slat set 42 wherein each slat 40 has a slat 40 length and a slat 40 width. Although each one of the slats 40 in the slat set 42 may have a generally planar configuration, each one the slats 40 may also include an angled portion 50 that extends downwardly from the planar portion 48, as shown in FIG. 3. It should be noted that the slats 40 in the slat set 42 may be configured in any number of alternate shapes and sizes. For example, each one of the slats 40 may include a generally curved portion that may extend downwardly from the planar portion 48. Additionally, each one of the slats 40 may have a cross-sectional shape that is curved or arc-shaped such as that shown in FIG. 3*b*.

Figure 3B:
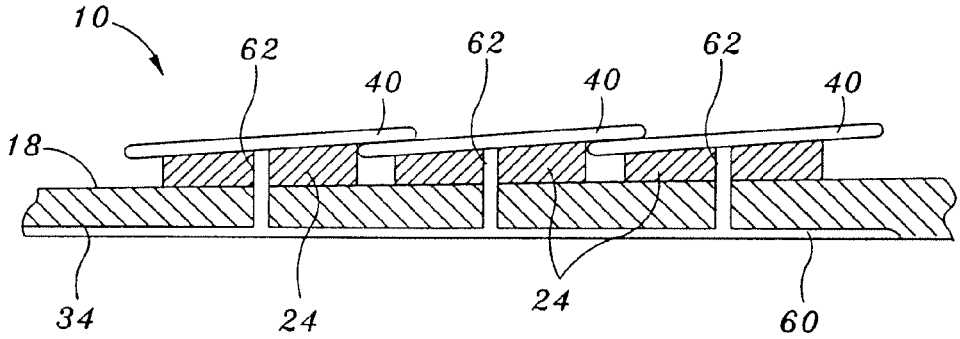
FIG. 3*b* is a partial cross-sectional view of the fixture assembly taken along line 3*b*-3*b* of FIG. 2 illustrating an alternative cross-sectional shape of the insert for supporting slats of overlapping configuration.

In still another configuration, each one of the slats 40 may be configured to overlap an adjacent one of the slats 40 such as is shown in FIG. 3*b*. However, regardless of the specific configuration, the fixture assembly 10 is preferably configured to support the slats 40 in a generally horizontal orientation essentially duplicating the slat 40 orientation when the window blind 38 is hung or suspended in a window installation. In this regard, the fixture assembly 10 is preferably configured to support the slats 40 such that the image graphic printed thereon may be displayed in a uniform and aesthetically pleasing manner.

Referring initially to FIG. 1, shown is a large format, ultraviolet (UV) radiation curable piezo inkjet printer 30 designated as the 3M Printer 2500UV which is commercially available from Minnesota Mining and Manufacturing Company and manufactured in cooperation with Leggett and Platt Digital Technologies. Such a printer 30 may be used with the fixture assembly 10 of the present invention. However, it is recognized herein that many other printers 30 may be used with the fixture assembly 10, as will be discussed in greater detail below.

As shown in FIG. 2, the fixture assembly 10 comprises a generally horizontally extending panel 34 having the plurality of inserts 24 mounted thereon in parallel spaced relation to one another. The panel 34 has an upper panel surface 18 with opposed panel ends 14 opposed panel sides 16 respectively defining a panel 34 length and a panel 34 width. The panel 34 also has four panel corners 56 in the configurations shown in FIGS. 1-6. It will be appreciated that the panel 34 may be provided in a number of alternative shapes and sizes other than the generally rectangular configuration shown in FIGS. 1-6. For example, the panel 34 may be provided in a generally square orientation.

As can be seen in FIGS. 2-3, the plurality of inserts 24 are preferably of substantially identical configuration although the insert 24 geometry may be variable along the panel 34 length and/or the panel 34 width such that slat sets 42 of variable configuration may be simultaneously printed. In this manner, a plurality of window blinds 38 of differing overall geometry may be printed on a single one of the fixture assemblies 10 in a single run of the printer 30. The inserts 24 may have an elongate shape as shown in FIG. 2 or the inserts 24 may be provided as a series of insert segments 36 similar to that shown in FIGS. 5-6 and as will be described in greater detail below. The inserts 24 may be mounted on the upper panel surface 18 in parallel spaced relation to one another. Each one of the inserts 24 is preferably spaced complementary to the slat 40 width such that the slats 40 are supported on the inserts 24 in substantially abutting contact with one another in order to minimize the risk of printing on non-planar portions 48 of the slats 40.

In addition, the inserts 24 are configured to receive and support the slats 40 in the generally horizontal orientation as shown in FIG. 3 in order to facilitate uniform application of ink to the slat sets 42 so as to achieve a high quality of the image graphic in its final form on the window blind 38. The inserts 24 are preferably configured to generally span the panel 34 width in order to simplify construction of the fixture assembly 10. However, it is contemplated that the inserts 24 may be configured in a variety of alternative configurations. For example, groups of the inserts 24 may be arranged orthogonally relative to one another such that slat sets 42 of different window blind 38 may be likewise arranged orthogonally to one another.

In such a configuration, a first group of inserts 24 may be arranged at one of the panel ends 14 with a second group of the inserts 24 being arranged orthogonally to the first group at an opposing one of the panel ends 14. The first group of inserts 24 may be arranged to receive the slat set 42 of a first one of the window blinds 38 having a specific length and width. The second group of inserts 24 may be arranged to receive the slat set 42 of a second one of the window blinds 38 having a length and width that may be different from that of the first one of the window blinds 38. By arranging the first group of inserts 24 perpendicularly relative to the second group of inserts 24, the economy of operation for the printer 30 may be improved wherein a variety of window blinds 38 of different sizes (e.g., the first and second ones of the window blinds 38) may be simultaneously printed on a single one of the fixture assemblies 10.

The panel 34 may be configured such that the panel 34 width is at least equivalent to the slat 40 length. Such a configuration of the panel 34 may be desirable for situations wherein a single configuration of the window blinds 38 must be printed in large quantities. By sizing the fixture assembly 10 to be generally complementary to the window blind 38, mounting of the slat sets 42 on the fixture assembly 10 is simplified wherein the slats 40 may be simply mounted upon the inserts 24. Toward this end, the fixture assembly 10 may include vertical side walls 20 that extend along the panel ends 14 and the panel sides 16.

Such side walls 20 may preferably extend upwardly to a level that is slightly above that of the upper insert 24 surface 26 such that ends of the slats 40 may be butted thereagainst. Such a configuration of the panel 34 may be provided in order to avoid the extra time and effort that may otherwise be required for precise alignment of slats 40 if the slat 40 length were generally unequal to the panel 34 width. Any such misalignment of adjacent ones of the slats 40 on the fixture assembly 10 would otherwise result in an aesthetically unappealing image graphic due to misalignment of adjacent ones of the slats 40 when the window blind 38 is installed in a hung position.

Referring now to FIG. 3, each one of the inserts 24 may have a generally rectangular cross-sectional shape with the generally horizontally disposed upper insert 24 surface 26 upon which the slats 40 may be mounted. In addition, each one of the inserts 24 may have at least one generally vertically disposed insert side 28. However, the inserts 24 may be provided in a variety of alternative configurations. For example, instead of the horizontally disposed upper insert 24 surface 26, the inserts 24 may be provided with a pair of spaced fins (not shown) extending upwardly in order to support each one of the slats 40. As was mentioned earlier, each one of the inserts 24 may have the planar portion 48 and the angled portion 50. Each one of the inserts 24 may preferably be sized complementary to the slat 40 such that the planar portion 48 is maintained in a generally horizontal orientation. In such an orientation, the angled portion 50 extends downwardly into abutting contact with the upper panel surface 18 and with the insert 24 side 28 of an adjacent one of the inserts 24.

Each one of the inserts 24 may include a rib 46 that is generally aligned with the upper insert 24 surface 26, as is shown in FIG. 3. The rib 46 may extend laterally outwardly from one of the insert sides 28. The inserts 24 may be oriented such that each one of the ribs 46 generally faces toward one of the panel ends 14. In this regard, the inserts 24 may be configured such that the ribs 46 face in one direction on the fixture assembly 10 such as toward one of the panel ends 14. As can be seen in FIG. 3, the angled portion 50 may extend downwardly and may be partially covered by the rib 46 of an adjacent one of the inserts 24. In addition, the insert 24 spacing is preferably substantially equivalent to the slat 40 width. In this manner, each one of the slats 40 may be disposed in generally abutting contact with one another so as to minimize the amount of overprinting on the angled portion 50.

Referring briefly to FIG. 3*a*, the window blind 38 may be configured such that adjacent ones of the slats 40 are disposed in partially overlapping relation to one another, as is common for plantation shutters in a closed position. In such a configuration, each one of the inserts 24 may have a generally wedge-shaped cross-sectional shape for supporting the slats 40 in an inclined orientation in the partially overlapping relation to one another in order to duplicate the arrangement of the window blind 38 in the closed position. As can be seen in FIG. 3*a*, each one of the slats 40 has a generally planar or flat configuration. However, it will be appreciated that the slats 40 may have alternative shapes such as curved or combination planar/angled shape that are oriented in partially overlapping relation to one another. In such cases, the inserts 24 may be configured complementary to the slats 40 so as to duplicate the relative orientation and positioning of the slats 40 when hung or suspended when the window blind 38 is placed in the closed position in a window installation.

Referring briefly now to FIG. 3*b*, shown are the inserts 24 in still another configuration wherein each one of the slats 40 has a generally curved cross-sectional shape. The upper insert 24 surface of each one of the slats 40 has a generally concave shape that is sized and configured to be complementary to the curved cross-sectional shape of the slats 40. Furthermore, the inserts 24 are preferably spaced so as to duplicate the spacing of the inserts 24 when hung in a window installation. In this regard, the inserts 24 are preferably spaced such that the slats 40 are disposed in substantially abutting contact with one another so as to reduce the risk of overprinting.

Referring briefly now to FIG. 2, the fixture assembly 10 of the present invention may be further configured to accommodate a valance 44 thereon such that the valance 44 may be printed simultaneous with the printing of the slat set 42. As was earlier mentioned, many window blind 38 include the valance 44 at a top of the window blind 38. The valance 44 is typically provided in order to cover a slat 40 control mechanism. The valance 44 is generally of one-piece construction and has a valance 44 width and a valance 44 length.

In many window blind 38, the valance 44 width is generally equal to that of the slat 40 width. However, the valance 44 length generally exceeds the slat 40 length. Therefore, the panel 34 may be configured such that the panel 34 width at one of the panel ends 14 is sized to accommodate the valance 44 length. In this regard, the panel 34 width and the side walls 20 of the fixture assembly 10 may be locally spaced wider than that at other portions of the panel 34. In addition, the panel 34 is preferably configured to position the valance 44 in relation to the slat set 42 such that the image graphic will be in alignment when the slats 40 are re-assembled and hung in an operative position.

Referring now to FIGS. 5-6, shown is the fixture assembly 10 as provided in an alternative embodiment in order to provide additional flexibility in the number of different sizes of window blind 38 that may be mounted on the fixture assembly 10. As was earlier mentioned, each one of the inserts 24 may be comprised of the series of insert segments 36 that are laterally spaced across the panel 34 width, as shown in FIG. 5. In this regard, the insert segments 36 are also longitudinally spaced across the panel 34 length. Thus, the insert segments 36 that make up each one of the inserts 24 are orthogonally arranged on the upper panel surface 18 in spaced parallel relation to one another. More specifically, the insert segments 36 are generally aligned with adjacent ones of the insert segments 36 in mutually perpendicular directions.

Each one of the insert segments 36 may preferably be of substantially identical configuration and may include all the features that are provided with the inserts 24 of one-piece construction shown in FIG. 3. In this regard, each one of the insert segments 36 may have the rectangular cross-sectional shape and may include at least one rib 46 extending laterally outwardly from one of the insert sides. The rib 46 may aid in supporting the planar portion 48 of the slat 40 as well as reduce the risk of overprinting on the angled portion 50 of the slat 40. However, it is contemplated that each one of the insert segments 36 may include a rib 46 on each one of the insert sides 28. In addition, each one of the insert segments 36 may have a square shape when viewed from above as shown in FIGS. 5-6. If configured in the square shape, each one of the insert segments 36 may have the rib 46 extending laterally outwardly from each one of the insert sides such that regardless of the orientation of slat sets 42 thereon, the rib 46 may prevents or reduce the risk of overprinting on the angled portions 50 of the slats 40.

Thus, it is contemplated that ribs 46 may be provided on any or all of the insert sides 28 of the insert segment 36. However, the insert segments 36 may be provided in a variety of alternative shapes, sizes and configurations. The lateral and longitudinal spacing of adjacent ones of the insert segments 36 may be substantially equivalent, although other lateral and longitudinal spacings are contemplated. In this regard, each one of the insert segments 36 in the series acts as part of the insert 24 in mutually perpendicular directions. For example, in reference to FIG. 6, the insert segment 36 that is closest to the panel corner 56 serves as part of the insert 24 that is aligned with the panel side 16. In addition, such insert segment 36 also serves as part of the insert 24 that is aligned with the panel end 14.

Referring still to FIGS. 5-6, the fixture assembly 10 of the alternative embodiment may be configured to accommodate the valance 44 thereon. As was earlier mentioned, in many window blind 38, the valance 44 length generally exceeds the slat 40 length. Therefore, in order to provide maximum flexibility in regards to the placement of slat sets 42 on the fixture assembly 10, each one of the panel corners 56 may be configured to accommodate the valance 44 thereon. As can be seen in FIGS. 5-6, edges of the panel corners 56 include recessed portions 58. The recessed portions 58 allow for positioning of the valance 44 in relation to the slat set 42 such that the image graphic will be in alignment when the slats 40 are re-assembled and hung in an operative position.

Referring more particularly to FIG. 6, inserts 24 sides 28 of each one of the insert segments 36 are in general alignment with each other. Furthermore, the insert segments 36 are generally aligned with ends of the recessed portion 58 at each of four of the panel corners 56 such that the insert segments 36 that are closest to the panel sides 16 and panel ends 14 are spaced away from the panel sides 16 and panel ends 14 by an amount equivalent to a length of recessed portion 58. The fixture assembly 10 may be configured such that a length of each one of the recessed portions 58 may be sized to be complementary to or substantially equivalent to the valance 44 width.

A preferred distance between recessed portions 58 along the panel ends 14 may be about forty-two inches. A preferred distance between recessed portions 58 along the panel sides 16 may be about ninety inches. By providing the inserts 24 as the series of insert segments 36, as shown in FIGS. 5-6, instead of as the elongate inserts 24 of one-piece construction, as shown in FIGS. 1-4, the operational flexibility of the fixture assembly 10 may be enhanced wherein a variety of window blind 38 of differing sizes may be simultaneously printed on a single one of the fixture assemblies 10.

In order to avoid ink buildup on the inserts 24 over time due to repeated overprinting of ink onto the fixture assembly 10, it is contemplated that the inserts 24 are preferably fabricated from material that is generally repellant or non-receptive to ink. In this regard, the non-receptive material may be a nylon polymeric material although many other suitable materials may be used for the inserts 24. Preferably, the inserts 24 and insert segments 36 are fabricated from a crystalline homopolymer acetalic resin known by the trade name Delrin® and which is commercially available from the Dupont Corporation. The panel 34 of the fixture assembly 10 may preferably be constructed of wood or metal such as steel in order to provide sufficient strength and rigidity during repeated uses of the fixture assembly 10. For ease of fabrication, the panel 34 may be fabricated from a sheet of ¾" thick plywood.

If included, the side walls 20 may also be fabricated of steel and may be welded to the panel 34 at the panel sides 16 and panel ends 14. Alternative materials may be used for fabricating the panel 34 including, but not limited to, fiberglass, polymeric material or any combination thereof. The inserts 24 may be secured to the panel 34 by means of mechanical fasteners 22 such as screws or bolts that may be threadably engaged to receiving bores formed in the upper panel surface 18. Wood screws or sheet metal screws with countersunk heads may be used to secure the inserts 24 to the upper panel surface 18 of wooden construction. Each one of the insert segments 36 may be fabricated of the same material as that described above for the inserts 24 of one-piece construction. In addition, each one of the insert segments 36 may be secured to the upper panel surface 18 with at least one or a plurality of mechanical fasteners 22 although other suitable means may be utilized.

Regarding the overall geometry of the fixture assembly 10, it is contemplated that a height of the fixture assembly 10 may be limited to three inches to ensure compatibility with commercially available printers such as the 3M Printer 2500UV from Minnesota Mining and Manufacturing Company. An overall width of the fixture assembly 10 may likewise be limited to about ninety-eight inches. A preferred overall length and width of the fixture assembly 10 may be about forty-eight inches by about ninety-six inches. However, it will be appreciated that the fixture assembly 10 may be fabricated in a variety of sizes, shapes and configurations other than the above-mentioned sizes. In addition, the fixture assembly 10 may include support members 12 configured to fixedly support the fixture assembly 10 such that the slat sets 42 may be readily mounted thereon prior to loading of the fixture assembly 10 on the printer 30.

Regarding types of printers 30 with which the fixture assembly 10 may be used, it is contemplated that the printer 30 may preferably be an inkjet printer 30 having a piezo inkjet printhead such that high quality, high resolution image graphics may be produced. The printer 30 may have a stationery flatbed or printer bed 32 upon which the fixture assembly 10 may be loaded and aligned. In typical flatbed printers, the fixture assembly 10 may be loaded onto the printer bed 32 in the manner shown in shown in FIG. 4. An inkjet printhead of the printer 30 may be mounted on a movable carriage enabling the printhead to be moved in perpendicular directions across the fixture assembly 10.

In typical flatbed printers such as that shown in FIG. 2, the printhead in connected to a computer that is programmed to energize nozzles of the printhead while the printhead traverses the fixture assembly 10 applying ink of varying colors to the slat set 42 in order to produce the image graphic. After application, the ink is cured such as by UV-radiation curing by UV-curing lamps. The use of UV radiation curable ink allows the ink to cure rapidly such that production speeds of over 1000 $ft^2$/hr are achievable, depending upon several variables including the desired resolution and the number of colors used in the image graphic.

Referring briefly to FIGS. 3, 3*a*, 3*b*, 6 and 7, shown are a series of generally parallel spaced vacuum channels 60 that may be included with or formed in the upper panel surface 18 and in the printer bed 32. If the panel 34 is fabricated from a sheet of ¾" thick plywood, the vacuum channels 60 may be easily formed therein by routing. The vacuum channels 60 may be arranged in general alignment with the inserts 24 as shown in FIG. 6 such that the vacuum channels 60 are positioned below a respective one of the inserts 24 or series of insert segments 36. Each one of the inserts 24 may include a series of vacuum ports 62 fluidly connecting the upper insert 24 surface to one of the vacuum channels 60.

Figure 7:
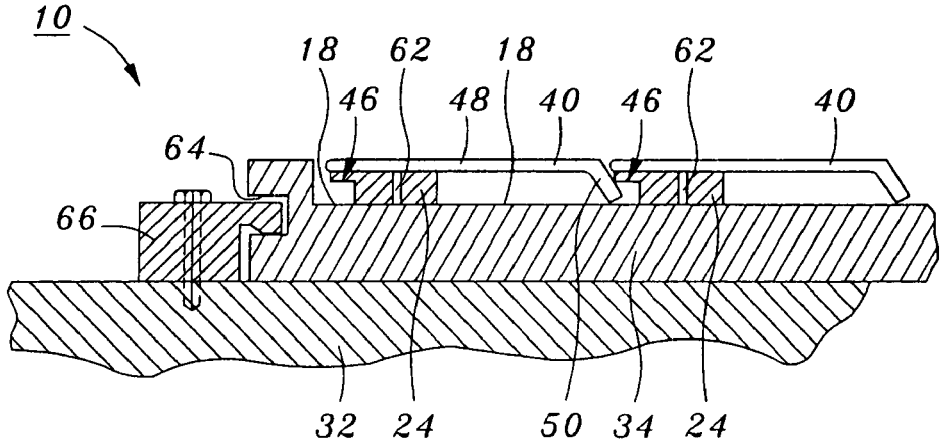
FIG. 7 is a partial cross-sectional view taken along line 7-7 of FIG. 1 illustrating a toe clamp engaged to a groove formed in a panel end in order to the fixture assembly to a printer bed of the printer.

In addition, vacuum ports 62 may also be formed as a manifold in the printer bed 32 and which may be fluidly connected to the vacuum channels 60 formed therein as shown in FIGS. 3 and 7. In this manner, low pressure applied through the vacuum channels 60 and vacuum ports 62 creates a suction force drawing the slats 40 against the inserts 24 in order to restrict slat 40 movement during printing of the slats 40. In this regard, the printer bed 32 may be configured as a vacuum table to hold the slat sets 42 in place during printing and which may alleviate skewing of the image graphic during subsequent passes of the print head due to inadvertent movement of the slat sets 42 relative to the print head.

If the fixture assembly 10 includes a series of insert segments 36, each one of the insert segments 36 may include a vacuum port 62 extending therethrough in order to fluidly connect the upper insert 24 surface to the vacuum channel, as shown in FIGS. 3, 3*a* and 3*b*. In such a configuration, each one of the vacuum channels 60 is preferably positioned to be in general alignment with one of the series of insert segments 36 such that low pressure applied through the vacuum ports 62 and vacuum channels 60 of the printer bed 32, through the vacuum channels 60 of the upper panel surface 18 and through the vacuum ports 62 of the insert segments 36 may create a suction force drawing the slats 40 downwardly against the insert segment 36 to restrict or prevent slat 40 movement such as may be desirable prior to and during the application of ink.

Referring briefly to FIG. 7, shown is the fixture assembly 10 mounted on the printer bed 32. As an aid in further preventing movement of the fixture assembly 10, a plurality of toe clamps 66 may be provided at the panel ends 14. If so included, the panel 34 may be adapted to be mounted upon the printer bed 32 of the printer 30 by including a groove 64 in each one of the vertical side walls 20 of each one of the opposing panel ends 14. As shown in FIG. 2 and in FIG. 7, the groove 64 may extend laterally into the side wall 20 and may extend along the panel 34 width. The groove 64 may additionally be configured to receive at least one of the toe clamps 66 in order to releaseably engage the panel ends 14. In this manner, the panel 34 may be secured to the printer bed 32.

The piezo inkjet printhead may rely on the use of standard four-color capability (i.e., cyan, magenta, yellow, and black) although one or two additional colors may be used (i.e., light cyan and light magenta), depending on the application. Such ink may preferably be compatible with polyvinyl chloride (PVC) material such as that utilized in slats 40 of many commercially available types of window blind 38. However, non-limiting examples of alternative materials from which the slats 40 may be fabricated include porous and nonporous materials such as wood and metal, etc.

Figure 4:
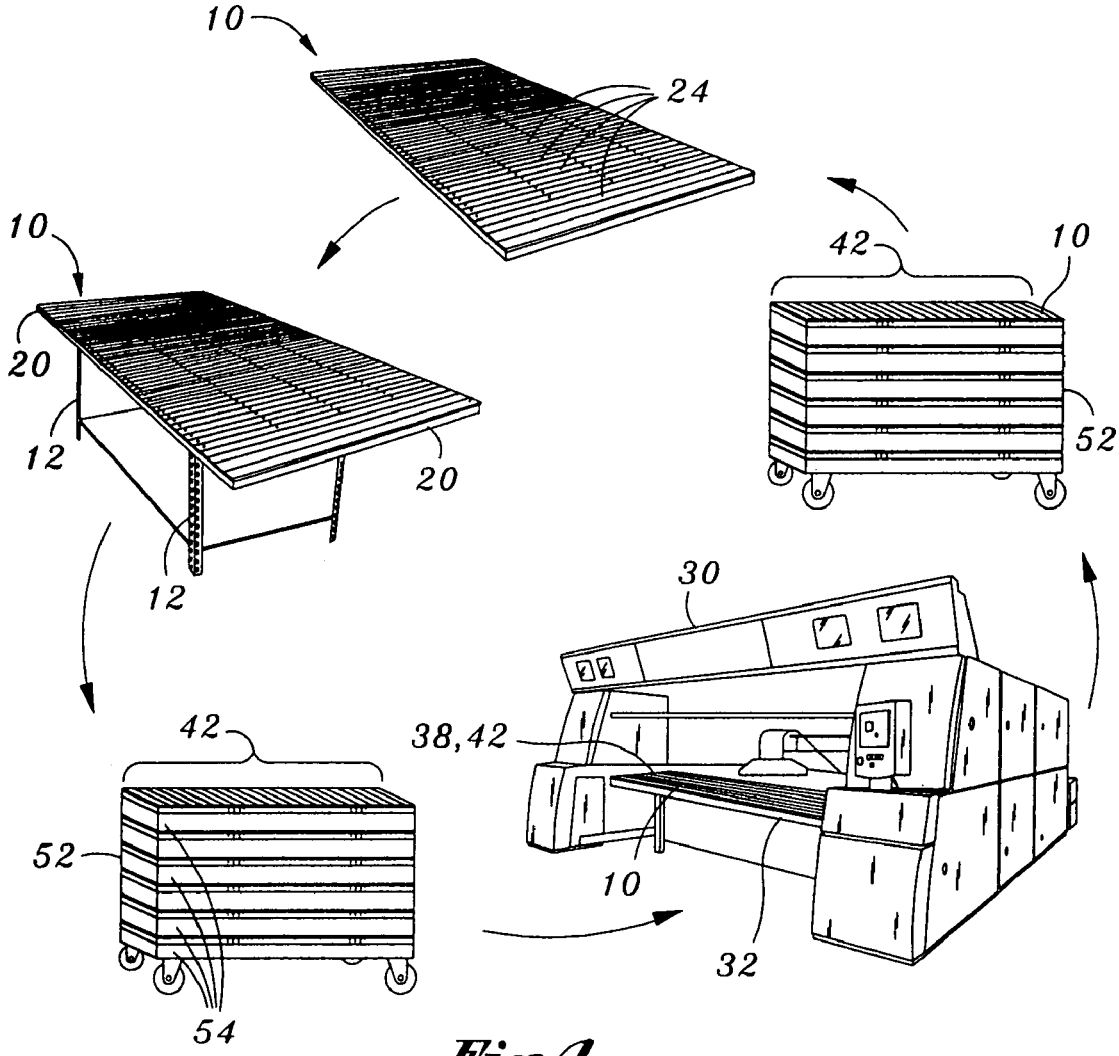
FIG. 4 illustrates a production cycle as representative of a method of printing image graphics on slats sets mounted upon multiple ones of the fixture assembly in assembly line fashion.

The operation of the fixture assembly 10 in cooperation with the printer 30 will now be described with reference to FIG. 4 illustrating a production cycle representative of a method of printing multiple ones of the slat sets 42 on a plurality of the fixture assemblies 10. As was earlier mentioned, the fixture assembly 10 includes the plurality of parallel spaced inserts 24 that are configured for mounting slat sets 42 in a generally horizontal orientation suitable for application of ink by the printer 30. The method allows for printing of at least one of the image graphic on a single one of the slat sets 42. In addition, the method also allows for simultaneous printing of at least one of the image graphics on multiple ones of the slat sets 42 using the printer 30. Furthermore, a method is also provided for printing at least one of the image graphics on a plurality of slat sets 42 using the printer 30 and a plurality of fixture assemblies 10 in assembly-line fashion, as is illustrated in FIG. 4.

In the method for printing at least one of the image graphics on a single one of the slat sets 42, the method comprises the steps of initially mounting the slat set 42 on the fixture assembly 10 such that the slats 40 are horizontally supported by the upper insert 24 surface 26 as shown in FIG. 3. Angled portions 50 of the slats 40 are preferably placed into abutting contact with the upper panel surface 18 and with the insert 24 side 28 of an adjacent one of the inserts 24. Rounded ones of the slats 40 may be mounted on the fixture assembly 10 in generally abutting contact in the manner shown in FIG. 3*a*. Partially overlapping ones of the slats 40 may be mounted on the fixture assembly 10 in the manner shown in FIG. 3*b*.

In addition, if the inserts 24 or insert segments 36 are provided with ribs 46, the slats 40 are preferably mounted such that the angled portions 50 extend underneath the rib 46 of the adjacent one of the inserts 24 or insert segments 36. Finally, it is preferable that the adjacent ones of the slats 40 are disposed in substantially abutting contact with one anther so as to minimize the risk of overprinting on the angled portions 50. It should be noted that the inserts 24 may be arranged on the panel 34 in such a manner so as to accommodate slat sets 42 that are mutually perpendicularly oriented relative to adjacent ones of the slat sets 42. Thus, multiple ones of the slat sets 42 may be simultaneously printed on a single one of the fixture assemblies 10.

Following mounting of the slat set 42 on the fixture assembly 10, the fixture assembly 10 is loaded onto the printer bed 32 of the printer 30 and positioned in substantial alignment with the printhead. If toe clamps 66 are included, such toe clamps 66 may be engaged to the groove 64 in the panel ends 14 and secured to the printer bed 32 in the manner shown in FIG. 7 using mechanical fasteners. As was earlier mentioned, the printer 30 may be an inkjet printer 30, such as a piezo inkjet printer 30 similar to that described above. If the fixture assembly 10 includes vacuum ports 32 and vacuum channels 60 in the printer bed 32, vacuum channels 60 in the upper panel surface 18 as well as vacuum ports 62 in the inserts 24 and/or insert segments 36, low pressure may be applied through the vacuum channels 60 and vacuum ports 62 by a vacuum source (not shown) to create the suction force and draw the slats 40 against the inserts 24 thereby restringing slat 40 movement during printing.

Ink, such as UV radiation curable ink, is then applied to the slat set 42 in order to form the image graphic thereon. The low pressure may be removed. The ink is then cured. If the ink is UV radiation curable ink, the ink may be cured by exposing the slat set 42 to UV radiation. The fixture assembly 10 is then offloaded from the printer bed 32 of the printer 30 by disengaging the toe clamps 66 from the grooves 64. The slat set 42 may then be demounted from the fixture assembly 10. Overprinting of ink on portions of the fixture assembly 10, such as on the inserts 24 or insert segments 36, may be readily removed depending on the non-receptive nature of the material from which the insert 24 may be fabricated. For example, if the inserts 24 are fabricated from nylon material, it is contemplated that ink overprinting may be removed by merely wiping the ink with a cloth.

Referring still to FIG. 4, the method for printing at least one of the image graphics on a plurality of slat sets 42 using the printer 30 and a plurality of fixture assemblies 10 may be performed in assembly-line fashion wherein the plurality of fixture assemblies 10 are provided. Single or multiple ones of the slat sets 42 may be mounted on each one of the plurality of fixture assemblies 10. A cart 52 having horizontal slots 54 may be provided such that the plurality of fixture assemblies 10 may be stored and transported to the printer 30. The fixture assemblies 10 may then be loaded onto the printer 30 in one-at-a-time fashion with the fixture assemblies 10 being positioned to be in general alignment with the printhead of the printer 30. The fixture assembly 10 may be secured to the printer bed 32 using toe clamps 66 engaged to the grooves 64. Low pressure may be applied through the vacuum channels 60 and vacuum ports 62 to restrict movement of the slats 40 on the inserts 24.

Ink, such as the UV radiation curable ink, is then applied to form the image graphic thereon. The ink is then cured such as by exposing the slat set(s) 40 to UV radiation. The fixture assembly 10 may then be offloaded onto the same one of the carts 52 or onto another one of the carts 52. In the same manner, unprinted ones of the fixture assemblies 10 may be successively loaded onto the printer 30, placed in substantial alignment with the printhead such that ink may be applied and cured followed by offloading of the fixture assembly 10. Following printing, the fixture assemblies 10 may be removed from the cart 52 such that all of the slat sets 42 may be successively demounted from the fixture assemblies 10. Ink overprinting of the fixture assemblies 10 and, more specifically, the inserts 24 thereof, may be removed in the manner described above.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A method for printing an image graphic on a slat set using a printer and a fixture assembly having a plurality of parallel spaced inserts configured for supporting the slat set in a generally horizontal orientation, the method comprising the steps of:

(a) mounting the slat set on the fixture assembly;

(b) loading the fixture assembly onto the printer such that the fixture assembly is in substantial alignment with a printhead;

(c) applying ink to the slat set to form the image graphic thereon;

(d) curing the ink;

(e) offloading the fixture assembly from the printer; and (f) demounting the slat set from the fixture assembly.

2. T he method of claim 1 wherein the fixture assembly has a panel with an upper panel surface including vacuum channels formed therein, each one of the inserts having an upper insert surface and at least one vacuum port fluidly connecting the upper insert surface to the vacuum channel, the method further comprising the step of:

applying low pressure through the vacuum channels and vacuum ports to create a suction force drawing the slats against the inserts in order to restrict slat movement prior to applying ink to the slat set.

3. The method of claim 1 wherein the ink is ultraviolet radiation curable ink and the step of curing the ink is performed by exposing the slat set to ultraviolet radiation.

4. The method of claim 1 further comprising the step of removing ink overprinting from the fixture assembly subsequent to demounting of the slat set.

5. The method of claim 1 wherein the printer is an inkjet printer.

6. The method of claim 5 wherein the inkjet printer is a piezo inkjet printer.

7. A method for printing an image graphic on a plurality of slat sets using a printer and a plurality of fixture assemblies, each one of the fixture assemblies having a plurality of parallel spaced inserts configured for mounting the slat sets in a generally horizontal orientation, the method comprising the steps of:

(a) providing the plurality of fixture assemblies;

(b) mounting one of the slat sets onto each one of the fixture assemblies;

(c) loading one of the fixture assemblies onto the printer such that the fixture assembly is in substantial alignment with a printhead of the printer;

(d) applying ink to the slat set to form the image graphic thereon;

(e) curing the ink;

(f) offloading the fixture assembly from the printer;

(g) repeating steps (c) through (g) until the image graphic has been applied to the slat sets; and (h) demounting each one of the slat sets from the fixture assemblies.

8. The method of claim 7 wherein the fixture assembly has a panel with an upper panel surface including vacuum channels formed therein, each one of the inserts has an upper insert surface and at least one vacuum port fluidly connecting the upper insert surface to the vacuum channel, the method further comprising the step of:

applying low pressure through the vacuum channels and vacuum ports to create a suction force drawing the slats against the inserts in order to restrict slat movement prior to applying ink to the slat set.

9. The method of claim 7 wherein the ink is ultraviolet radiation curable ink and the step of curing the ink is performed by exposing the slat set to ultraviolet radiation.

10. The method of claim 7 further comprising the step of removing ink overprinting from each one of the fixture assemblies subsequent to demounting of the slat sets.

11. The method of claim 7 wherein at least one of the fixture assemblies has a plurality of the slat sets mounted thereon.

12. The method of claim 7 wherein the printer is an inkjet printer.

13. The method of claim 12 wherein the inkjet printer is a piezo inkjet printer.

* * * * *